United States Patent [19]

Azzerri et al.

[11] 4,127,450

[45] Nov. 28, 1978

[54] METHOD FOR PRETREATING SURFACES OF STEEL PARTS FOR ELECTROPLATING WITH ORGANIC OR INORGANIC COATINGS

[75] Inventors: Nazzareno Azzerri; Alberto Tamba, both of Rome, Italy

[73] Assignee: Centro Sperimentale Metallurgico S.p.A., Rome, Italy

[21] Appl. No.: 726,788

[22] Filed: Sep. 27, 1976

[30] Foreign Application Priority Data

Sep. 26, 1975 [IT] Italy ..... 51516 A/75

[51] Int. Cl.$^2$ ..... C25D 5/36

[52] U.S. Cl. ..... 204/29; 204/34

[58] Field of Search ..... 204/29, 34, 144.5, 181 R, 204/181 N, 29.34

[56] References Cited

U.S. PATENT DOCUMENTS

| | | | |
|---|---|---|---|
| 1,041,790 | 10/1912 | Herrmann | 204/34 |
| 2,685,564 | 8/1954 | Emmett et al. | 204/144.5 |
| 3,075,897 | 1/1963 | Higgs | 204/34 |

*Primary Examiner*—John H. Mack
*Assistant Examiner*—William Leader
*Attorney, Agent, or Firm*—Young & Thompson

[57] ABSTRACT

The susceptibility of steel to electroplating is improved, by an electrolytic pretreatment of the steel part. The steel part is connected alternately as cathode and anode in an electrolytic cell containing an electrolytic bath which is an aqueous solution of sodium sulphate of a concentration from 0.5 M to 2.5 M and a pH of 6 to 8, at a temperature of 20° to 100° C. and a direct current density of 1 to 60 A/dm$^2$.

1 Claim, No Drawings

METHOD FOR PRETREATING SURFACES OF STEEL PARTS FOR ELECTROPLATING WITH ORGANIC OR INORGANIC COATINGS

The present invention relates to improving the susceptibility of steel to electroplating, more particularly by an electrolytic pretreatment of steel parts.

It is known that metal parts for electroplating must be subjected to thorough cleaning and to surface activation if a good coating is to be obtained. In the case of steel parts, currently adopted pretreatments include surface preparation, cleaning, and acid pickling; however, the practical application of this particular technology gives rise to numerous problems and limitations which up to now have not been overcome.

In the main, these drawbacks result from the fact that the detergents, deoxidizers and activating agents used are highly corrosive and therefore: (i) reduce the operating life of line equipment and increase maintenance costs; (ii) require additional health and safety precautions; and (iii) generate toxic waste products which (a) pollute the environment and contribute in no mean way to upsetting ecological and geochemical equilibria, and (b) require sophisticated and costly disposal systems.

The invention comprises a method for pretreating steel surfaces for electroplating, based on the use of an aqueous solution of substantially neutral pH (6 to 8). Essentially, the solution contains sodium sulphate in a concentration from 0.5 M to 2.5 M, but other salts derived from mineral acid may also be included in varying proportions.

Pretreatment of the steel surface with the neutral electrolytic solution consists essentially in (i) establishing an electrolytic cell in which the neutral solution is the electrolyte and the metal part to be plated is alternately the anode and the cathode in a DC circuit; and (ii) causing the electrolyte to act on the metal part under the following operating conditions:

temperature of solution:20° to 100° C.
duration of treatment:0.1 second to 1 minute
current density:1 to 60 A/dm$^2$ The redox reactions which take place during the treatment can be summarized as follows:

Anode (positive pole):$2\ OH^- \rightleftarrows H_2O + 1/2O_2 + 2e$
Cathode (negative pole):$2\ H^+ + 2e \rightleftarrows H_2$
Overall reaction:$2\ OH^- + 2\ H^+ \rightleftarrows H_2O + 1/2O_2 + H_2$ These reactions show that the positive and negative ions of the sodium sulphate and of any other salts (if present) do not take part in the cathodic and anodic oxidizing-reducing processes. As a result, there is no solute consumption during pretreatment of the metal surface with the neutral solution, but only consumption of the $OH^-$ and $H^+$ ions produced by dissociation of the water (which must therefore be topped up periodically). The electrolyte's surface-activating effect is, of course, a result of secondary reactions in which the solution's constituents play a well defined role.

The process can be performed on steel workpieces batchwise, or continuously as in the case of continuously moving strip that passes through an electrolytic bath.

The workpiece is preferably connected in a DC circuit first as cathode and then as anode. However, the reverse sequence is also possible. Moreover, the polarity of the direct current can be changed in a number of repeating cycles, for example: cathode-anode-cathode-anode-cathode-anode, etc.

It is not necessary that the total time as anode be exactly the same as the total time as cathode. Of course, in the case of continuously moving strip, the total time is generally, for obvious reasons, the same for both anodic and cathodic steps.

The process of the present invention is of particular utility as a pretreatment for electroplating with tin, zinc, lead and tin alloys. However, it is useful also as a prelude to electroplating with other organic or inorganic coatings.

Compared with standard or traditional methods for pretreating steel surfaces for electroplating, the invention offers the following advantages in addition to those already described:

- improvement of finished product quality in the case of both organic and inorganic coatings;
- autoregeneration of pretreatment bath;
- longer equipment operating life;
- reduced maintenance and repair costs;
- elimination of all acid storage and handling problems;
- absence of noxious and/or corrosive fumes in the shop and, therefore, safer and more healthy work conditions;
- no risk of environmental pollution; and
- elimination (in certain cases) of the need for preliminary surface degreasing operations.

In order to enable those skilled in this art to practice the invention, the following illustrative examples, first of the prior art and then of the invention, are given:

EXAMPLE 1

As an example of the prior art, a 0.2 mm. steel strip (black plate) was preliminarily electrolytically degreased in a conventional commercial alkaline cleaning solution, and was then continuously fed through an electrolytic pickling bath of 8% aqueous $H_2SO_4$ solution at about 40° C. for about four seconds at a constant polarity current density of 20 A/dm$^2$. The strip was then passed immediately to a conventional "Ferrostan" electrotinning bath operating at a temperature of 45° C. and with a current density of 20 A/dm$^2$. The feed rate of the line was 200 m/min.; and the product was brightened by flash melting. The protectiveness of the intermediate Fe-Sn alloy thus formed according to the prior art, was evaluated on the basis of polarization resistance measurement, because polarization resistance is proportional to corrosion resistance. For the strip thus pretreated and tin plated according to the prior art, the value measured for polarization resistance was R = 19.8 KΩ cm$^2$.

EXAMPLE 2

As an example of the present invention, the same type strip was degreased and tinned under the same conditions as in Example 1, except that instead of electrolytic pickling in 8% aqueous $H_2SO_4$ solution as in Example 1, the strip was run continuously through a 1.5 M aqueous solution of $Na_2SO_4$ at a temperature of about 40° C., for a total immersion time of four seconds. The first 2 seconds, the strip was connected as cathode and the last two seconds it was connected as anode. A current density of 20 A/dm$^2$ was used.

After tinplating and brightening as in Example 1, the weight of tin coating was 11.2 g/m$^2$, and the polarization resistance was measured and had a value of R = 24.2 KΩ cm$^2$.

An increase of more than 20% in corrosion-resistance was thus obtained, attributable solely to the pretreatment according to the present invention instead of according to the prior art.

Although the present invention has been described in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. A method of producing on a steel part a tin plating of improved corrosion resistance, comprising the steps of immersing a steel part in an aqueous solution of sodium sulphate of a concentration from 0.5 M to 2.5 M and a pH of 6 to 8 at a temperature of 20° to 100° C., connecting the immersed part first as cathode for about two seconds and then as anode for about two seconds at a current density of 1 to 60 $A/dm^2$, and subsequently electrotinplating said part.

* * * * *